US012172855B2

(12) United States Patent
Okada et al.

(10) Patent No.: US 12,172,855 B2
(45) Date of Patent: Dec. 24, 2024

(54) PRINTING APPARATUS

(71) Applicant: SEIKO EPSON CORPORATION, Tokyo (JP)

(72) Inventors: Hiroyoshi Okada, Matsumoto (JP); Shoichi Murata, Yamagata-mi (JP)

(73) Assignee: Seiko Epson Corporation, Tokyo (JP)

( * ) Notice: Subject to any disclaimer, the term of this patent is extended or adjusted under 35 U.S.C. 154(b) by 122 days.

(21) Appl. No.: 17/934,616

(22) Filed: Sep. 23, 2022

(65) Prior Publication Data

US 2023/0096784 A1 Mar. 30, 2023

(30) Foreign Application Priority Data

Sep. 27, 2021 (JP) ..... 2021-156413

(51) Int. Cl.

| | |
|---|---|
| ***B41J 15/04*** | (2006.01) |
| ***B65H 20/00*** | (2006.01) |
| ***B65H 20/02*** | (2006.01) |
| ***B65H 43/08*** | (2006.01) |

(52) U.S. Cl.

CPC ..... *B65H 20/005* (2013.01); *B65H 20/02* (2013.01); *B65H 43/08* (2013.01); *B65H 2402/441* (2013.01); *B65H 2553/51* (2013.01); *B65H 2555/25* (2013.01); *B65H 2557/10* (2013.01); *B65H 2801/12* (2013.01)

(58) Field of Classification Search

CPC ..... B41J 15/042; B41J 3/4075; B41J 3/36; B65H 20/005; B65H 20/02; B65H 2557/10

See application file for complete search history.

(56) References Cited

U.S. PATENT DOCUMENTS 6,068,420 A * 5/2000 Austin ..... B41J 2/32 400/690.1

2019/0202218 A1 7/2019 Ogawa et al.

FOREIGN PATENT DOCUMENTS

JP 2019-119117 A 7/2019

JP 2021119049 A * 8/2021

* cited by examiner

*Primary Examiner* — Luis A Gonzalez

(74) *Attorney, Agent, or Firm* — WORKMAN NYDEGGER

(57) ABSTRACT

A printing apparatus includes a container that can accommodate roll paper in which recording paper is wound; a cover for opening and closing the container; a transporter, including a transport motor and a transport roller, that pulls the recording paper from the roll paper and transports the recording paper; a printing section that performs printing on the recording paper at a position facing the transport roller; a first substrate that has a controller controlling the printing section; and a second substrate disposed to intersect the first substrate, in which the transport motor is surrounded by the first substrate, the second substrate, and the container and a shaft of the transport motor is disposed parallel to a shaft of the transport roller.

5 Claims, 5 Drawing Sheets

PRINTING APPARATUS

The present application is based on, and claims priority from JP Application Serial Number 2021-156413, filed Sep. 27, 2021, the disclosure of which is hereby incorporated by reference herein in its entirety.

BACKGROUND

1. Technical Field

The present disclosure relates to a printing apparatus.

2. Related Art

JP-A-2019-119117 describes a known printing apparatus in which a motor that transports recording paper is disposed outside a frame.

However, reducing the size of the printing apparatus described in JP-A-2019-119117 cannot be easily achieved because additional space for disposing the motor that transports recording paper needs to be provided outside the frame or the like.

SUMMARY

According to an aspect of the present disclosure, there is provided a printing apparatus including: a container configured to accommodate roll paper in which recording paper is wound; a cover for opening and closing the container; a transporter including a transport motor and a transport roller, the transporter pulling the recording paper from the roll paper and transporting the recording paper; a printing section performing printing on the recording paper at a position facing the transport roller; a first substrate having a controller controlling the printing section; and a second substrate disposed to intersect the first substrate, in which the transport motor is disposed in a space formed by the first substrate, the second substrate, and the container, and a shaft of the transport motor is disposed parallel to a shaft of the transport roller.

DESCRIPTION OF EXEMPLARY EMBODIMENTS

1. Embodiments

Figure 1:
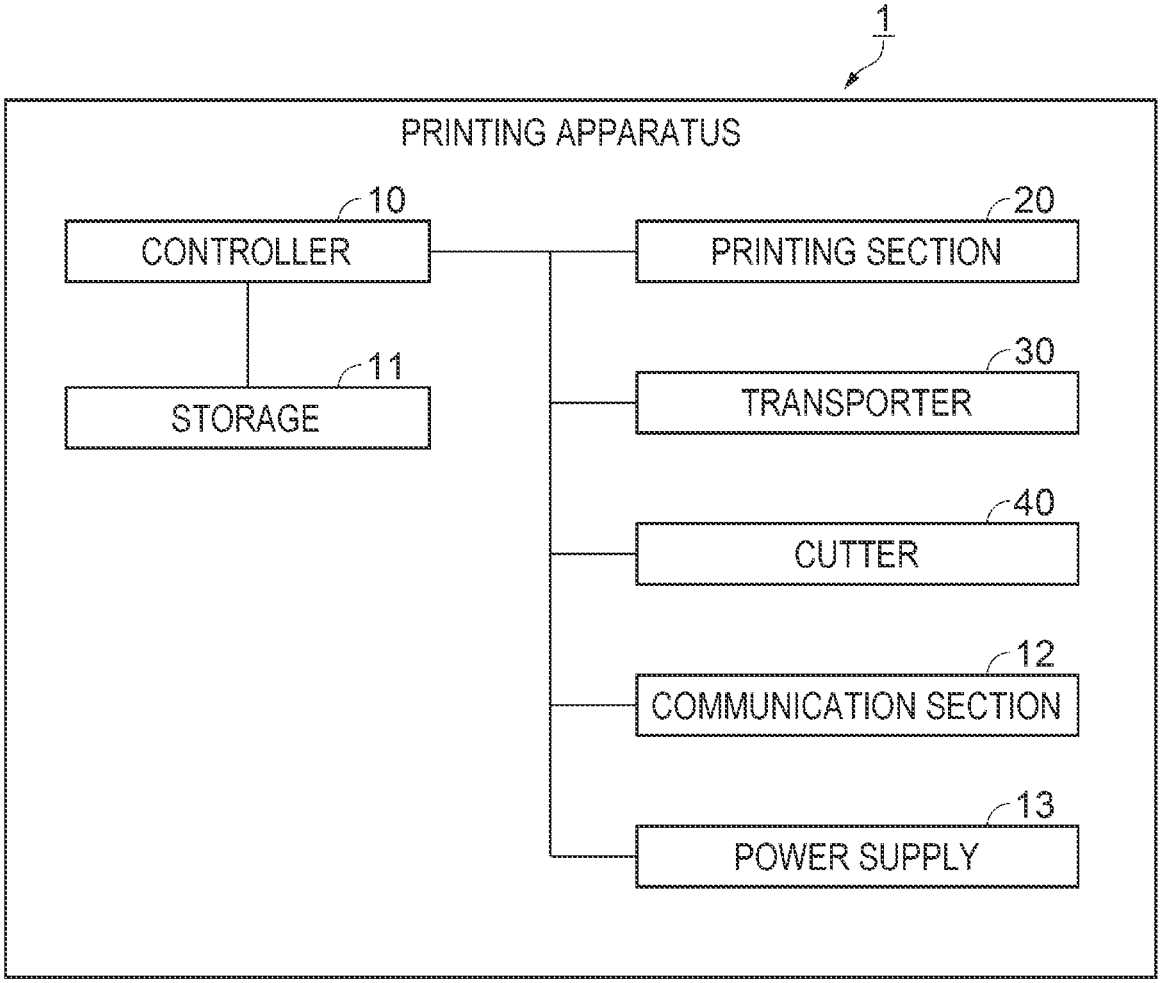
FIG. 1 is a block diagram illustrating the structure of a printing apparatus.

Embodiments will be described with reference to the drawings. It should be noted that the directions in the drawings will be described using a three-dimensional coordinate system in which the X-, Y-, and Z-axes are orthogonal to each other. For convenience of description, the positive direction of the Z-axis is referred to as the upward direction or simply the top and the negative direction of the Z-axis is referred to as the downward direction or simply the bottom, the positive direction of the X-axis is referred to as the right direction or simply the right and the negative direction of the X-axis is referred to as the left direction or simply the left, and the positive direction of the Y-axis is referred to as the back direction or simply the back and the negative direction of the Y-axis is referred to as the front direction or simply the front.

A printing apparatus 1 according to an embodiment is used in, for example, point of sale (POS) systems. POS systems are used in retail businesses such as shopping centers, department stores, convenience stores, and in-car sales, and in eating and drinking businesses such as restaurants, coffee shops, and pubs. A POS system has a function of accounting in accordance with goods and services purchased by customers and a function of issuing receipts in response to purchases.

When shop staff in a retail business, an eating or drinking business, or the like need to issue a receipt or other documents for accounting, the shop staff operate a POS system and send the print data from the computer to the printing apparatus 1, issue the receipt through the printing apparatus 1, and give the receipt to the customer.

The printing apparatus 1 is installed at the counter at which accounting is performed in a shop. Since the installation space of the printing apparatus 1 at the counter is limited, the printing apparatus 1 needs to be small.

1-1. Structure of the Printing Apparatus

As illustrated in FIG. 1, the printing apparatus 1 includes a controller 10, storage 11, a printing section 20, a transporter 30, a cutter 40, a communication section 12, and a power supply 13. The structure of the printing apparatus 1 will be described with reference to FIGS. 2 to 6 as well.

Figure 2:
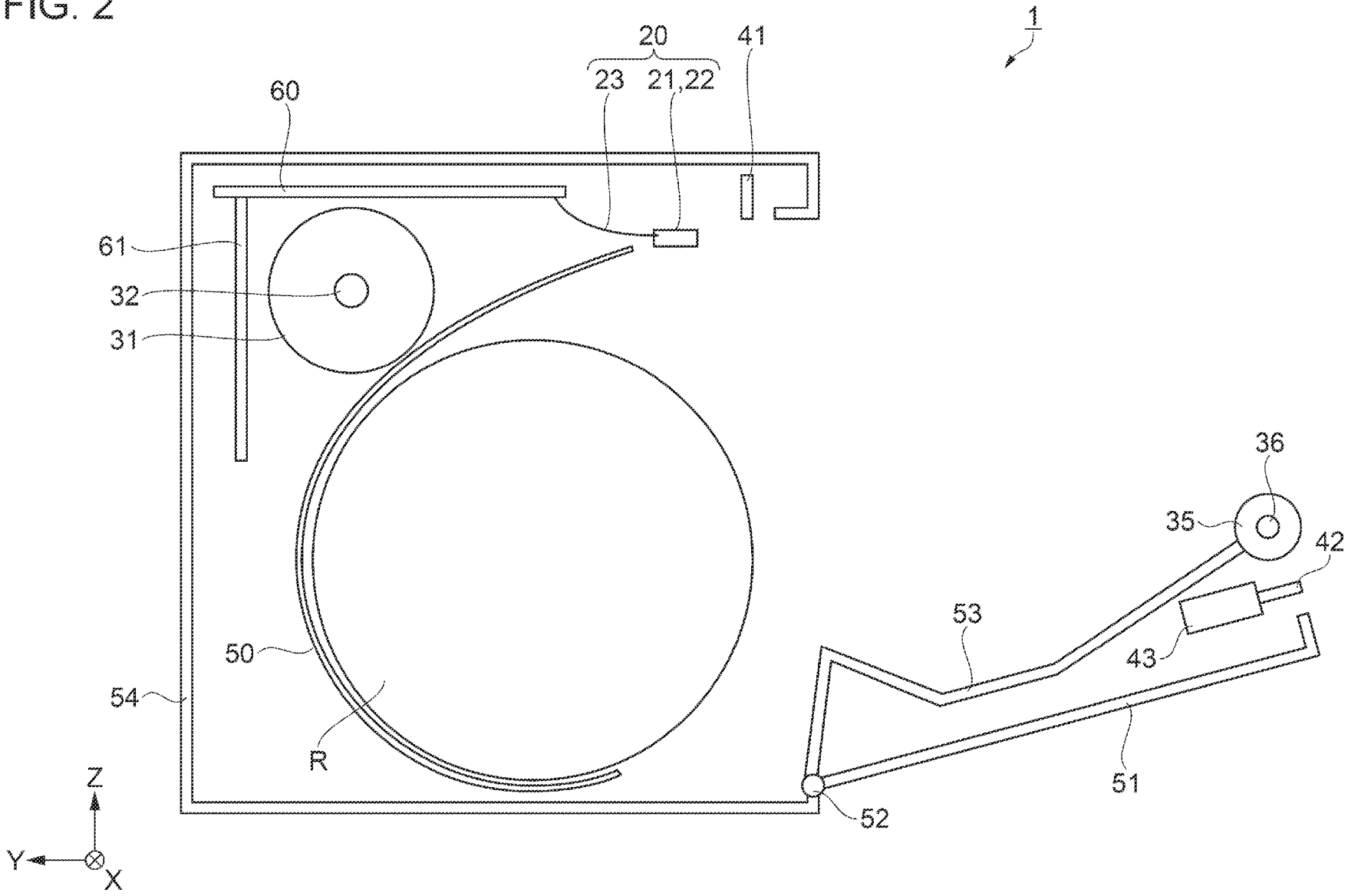
FIG. 2 is a sectional view illustrating the structure of the printing apparatus in which a container is opened by opening a cover.

As illustrated in FIG. 2, a cover 51 is pivotally attached to a case 54 via a hinge 52. A container 50 can accommodate roll paper R in which recording paper P is wound. The cover 51 pivots to move between the state in which the container 50 is open and the state the container 50 is closed.

FIG. 2 illustrates the state in which the container 50 is opened by opening the cover 51. In the following description, the state in which the container 50 is opened by opening the cover 51 is also referred to as the state in which the cover 51 is open.

Figure 3:
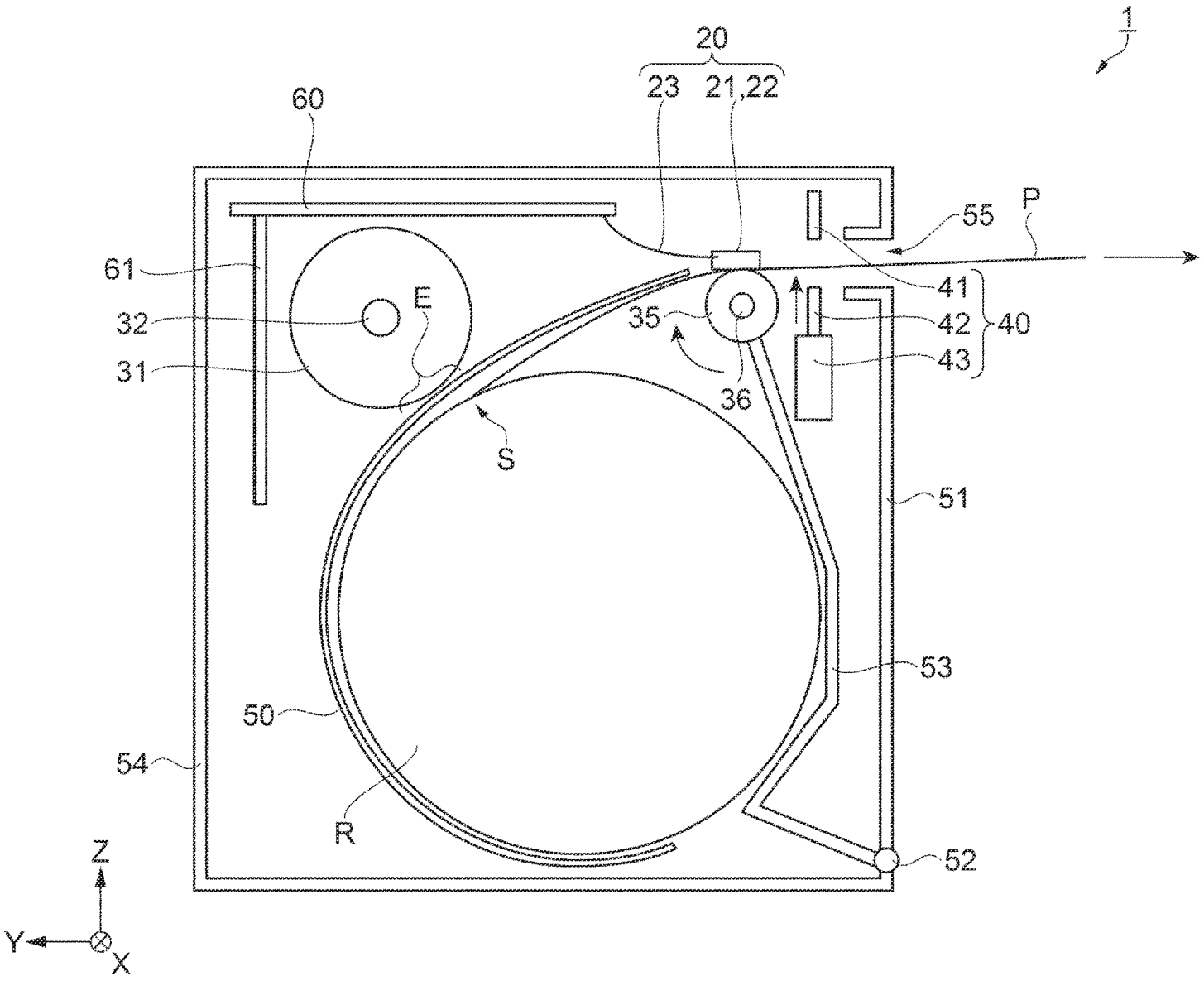
FIG. 3 is a sectional view illustrating the structure of the printing apparatus in which the container is closed by closing the cover.

It should be noted that FIG. 3 illustrates the state in which the container 50 is closed by closing the cover 51. In the following description, the state in which the container 50 is closed by closing the cover 51 is also referred to as the state in which the cover 51 is closed.

The components related to the mechanism disposed in a case 54 include a fixed blade 41, which is a second blade included in the cutter 40, the printing section 20 including a head 21, a transport motor 31 included in the transporter 30, the container 50, and the like.

Figure 6:
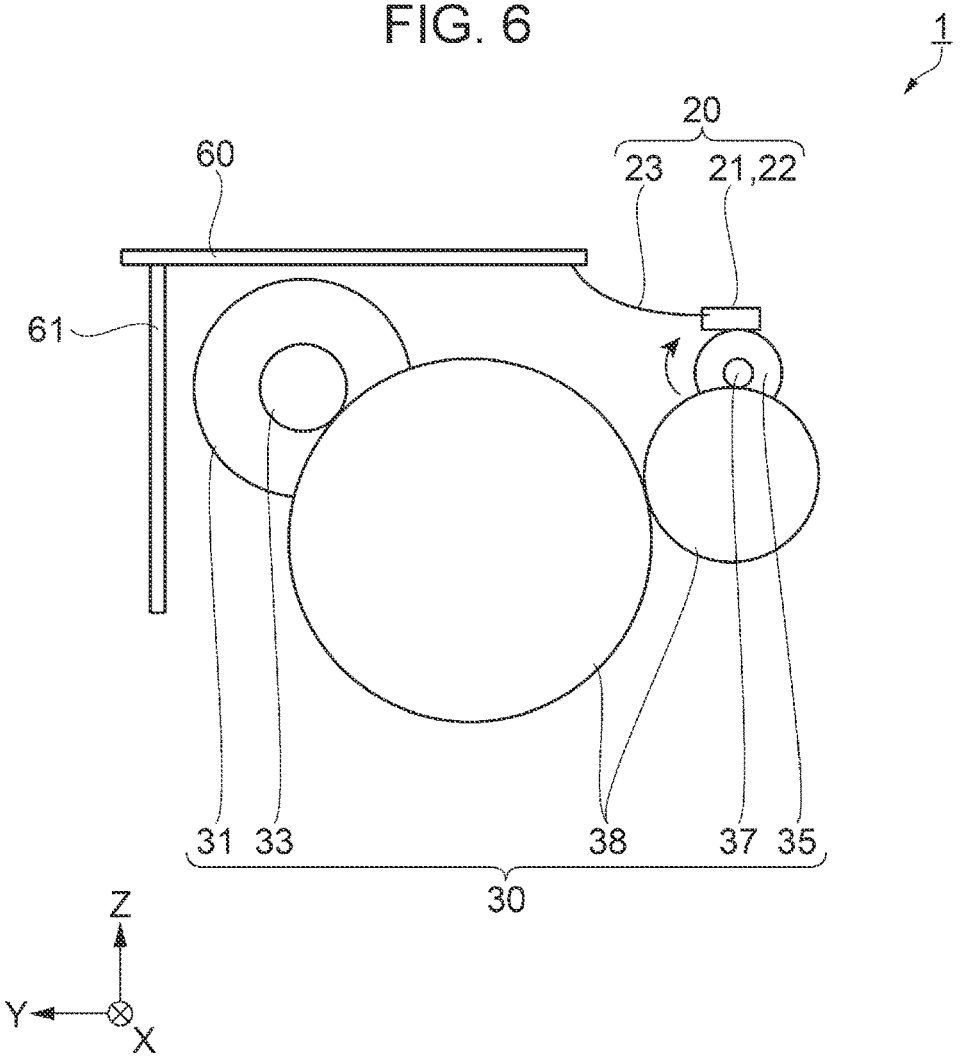
FIG. 6 is a diagram illustrating the transmission of torque from the transport motor to a transport roller.

It should be noted that the transporter 30 includes a transport motor 31, a wheel row 38, and a transport roller 35, as illustrated in FIG. 6.

In addition, a main substrate 60, which is the first substrate, and a sub-substrate 61, which is the second substrate, are provided in the case 54.

The main substrate 60 has at least the controller 10 controlling the printing section 20, which will be described later. The sub-substrate 61 has at least the communication section 12 and the power supply 13, which will be described later.

The main substrate 60 and the sub-substrate 61 are coupled to each other by an internal connector. The internal connector is, for example, of the type that couples boards in a vertical orientation. The main substrate 60 and the sub-substrate 61 are disposed with the internal connector as described above to intersect each other.

As illustrated in FIG. 2, the transport motor 31 is surrounded by the main substrate 60 from the top of the printing apparatus 1, the sub-substrate 61 from the back of the printing apparatus 1, and the container 50 from the front and the bottom.

The case 54 has a rectangular parallelepiped shape to reduce the space taken by the printing apparatus 1 installed at the counter in a shop. In addition, the container 50 has an arc shape that follows the shape of the roll paper R to accommodate the roll paper R.

In the printing apparatus 1, a so-called dead space, which is an empty space having no other components, is likely to be formed between the arc-shaped container 50 and a side of the rectangular parallelepiped case 54.

Specifically, a particularly large dead space is formed at a position, near the printing section 20, between a part of the arc-shaped container 50 and an upper-rear side of the case 54.

When the main substrate 60, the sub-substrate 61, and the transport motor 31 are disposed in this dead space as illustrated in FIG. 2, the space efficiency in the printing apparatus 1 is improved. In particular, the size of the printing apparatus 1 can be reduced since no additional space for disposing the transport motor 31 needs to be provided in the printing apparatus 1.

The transport motor 31 has a cylindrical shape centered on a transport motor shaft 32. As illustrated in FIG. 2, the cylindrical transport motor 31 is disposed in the dead space such that the portion corresponding to the outer periphery of the cylindrical shape is surrounded by the main substrate 60, the sub-substrate 61, and the container 50.

This dead space also extends in the printing apparatus 1 in the left/right directions. The transport motor 31 is disposed such that the transport motor shaft 32 projecting from the transport motor 31 is aligned in the left/right directions of the dead space. In other words, the transport motor 31 is disposed such that the direction corresponding to the height direction of the cylindrical shape of the transport motor 31 is aligned with the left/right directions of the dead space.

As a result, the transport motor 31 including the transport motor shaft 32 can be efficiently disposed to fit the space that also extends in the left/right directions of the dead space, and the size of the printing apparatus 1 can be further reduced.

As described above, the main substrate 60, the sub-substrate 61, and the container 50 are efficiently disposed in the dead space, which is an empty space in the printing apparatus 1 and has no other components, to surround the cylindrical transport motor 31. The size of the printing apparatus 1 does not need to be increased to create a space for disposing the transport motor 31, thereby enabling the size of the printing apparatus 1 to be reduced.

Furthermore, even if an attempt is made to enlarge the transport motor 31, the transport motor 31 can be enlarged in the diameter direction of the cylindrical shape to fit the dead space and can also be enlarged in the shaft direction of the transport motor shaft 32 because the dead space also extends in the left/right directions. As described above, the size of the transport motor 31 to be disposed in the dead space is flexible.

It should be noted that the roll paper R also has a cylindrical shape. A winding core made of paper or plastic resin is present at the center of the circle of the cylindrical shape of the roll paper R. The direction of the axis of the winding core of the roll paper R, which is the height direction of the cylindrical shape of the roll paper R accommodated in the container 50, is parallel to the transport motor shaft 32 of the transport motor 31. As a result, wasted space including the roll paper R, the container 50 for accommodating the roll paper R, and the transport motor 31 can be suppressed, thereby achieving efficient arrangement.

On the other hand, the components related to mechanisms attached to the cover 51 include the transport roller 35 included in the transporter 30, a movable blade 42, which is the first blade included in the cutter 40, a cutter motor 43 that moves the movable blade 42, a guide 53 that can regulate the roll paper R, and the like.

As illustrated in FIGS. 2 and 3, the transport motor shaft 32, which is the shaft at the rotation center of the transport motor 31, is disposed parallel to a transport roller shaft 36, which is the shaft at the rotation center of the transport roller 35. In other words, the transport motor shaft 32 is disposed parallel to the transport roller shaft 36. By disposing the transport motor 31 and the transport roller 35 parallel to the shafts thereof, the wasted space can be suppressed, the transport motor 31 and the transport roller 35 can be disposed in the printing apparatus 1 with high space efficiency, and the size of the printing apparatus 1 can be further reduced.

It should be noted that FIGS. 2 and 3 illustrate an example of installing the printing apparatus 1 such that the cover 51 is located as the front surface of the printing apparatus 1, but the printing apparatus 1 may be installed such that the cover 51 is located as the upper surface. With such positioning of the printing apparatus 1, since an outlet 55, described later, that is formed by the cover 51 is located in the front surface or the upper surface of the printing apparatus 1, the recording paper P, which is printed and ejected through the outlet 55, can be easily taken by the shop staff.

FIG. 3 illustrates the state in which the container 50 is closed by closing the cover 51. In this case, the transport roller 35 of the transporter 30 provided behind the cover 51 faces the head 21 of the printing section 20, which is provided in the case 54. As described above, when the cover 51 is closed, the head 21 is at a position at which printing on the recording paper P is enabled.

In addition, the wheel row 38 engages a transport roller gear 37 of the transport roller 35 as described later, and the torque can be transmitted from the transport motor 31 to the transport roller 35. As described above, when the cover 51 is closed, the transport roller 35 is at a position at which the transport roller 35 can transport the recording paper P.

A shop staff member opens the cover 51, places the roll paper R into the container 50, and sets the roll paper R by closing the cover 51.

The printing section 20 has a pressing mechanism that presses the head 21 against the transport roller 35. The recording paper P is pinched by the pressing mechanism with a predetermined pressing force between the head 21 and the transport roller 35. When the transport roller 35 is rotated clockwise by the transport motor 31, the recording paper P pinched between the head 21 and the transport roller 35 is pulled from the roll paper R and transported.

It should be noted that the transport roller 35 is made of a flexible material, such as silicone rubber. By pinching the recording paper P with the head 21, the transport roller 35 can generate a frictional force for transporting the recording paper P.

As illustrated in FIG. 3, the recording paper P is pulled from the roll paper R by the transport roller 35 at a pull position S.

The part of the container 50, corresponding to the pull position S, that can regulate the recording paper P or the roll paper R is a part E of the container 50. The part E is also a part of the container 50 that can surround the transport motor 31 with the main substrate 60 and the sub-substrate 61.

In addition, the part E is located in a range within the container 50 that is closest to the transport motor 31.

It should be noted that, when the recording paper P is pulled from the roll paper R, the roll paper R may roll in the front/rear directions. The guide 53 provided behind the cover 51 also has an arc shape that follows the shape of the roll paper R, as with the container 50. The roll paper R is prevented from rolling in the front/rear directions due to being restricted in the front/rear directions by the container 50 and the guide 53.

The head 21 of the printing section 20 is, for example, a line thermal head having a plurality of heating elements linearly arranged. When receiving print data via the communication section 12, the controller 10 selects a heating element from the plurality of heating elements of the head 21 in accordance with the print data and generates heat by applying a drive voltage.

The recording paper P is thermal paper. The recording paper P develops color due to heating of the heater element and is printed according to the print data.

It should be noted that because the head 21 is a line thermal head, the recording paper P is printed by the head 21 while being transported by the transport roller 35.

As illustrated in FIG. 3, when the cover 51 is closed, the movable blade 42 of the cutter 40 provided behind the cover 51 faces the fixed blade 41 provided in the case 54, and the movable blade 42 and the fixed blade 41 can slide against each other.

In addition, closing the cover 51 forms the rectangular outlet 55 at the boundary between the end of the cover 51 opposite to the hinge 52 and the part of the case 54 facing the end of the cover 51.

The fixed blade 41 is formed by a rectangular parallelepiped piece of metal, and the tip of one of the sides is a cutting edge. The movable blade 42 is formed by, for example, a V-shaped piece of metal, and the tip of the V-shape is a cutting edge.

Under control of the controller 10, the movable blade 42 is moved by the cutter motor 43 of the cutter 40. The movable blade 42 is a so-called cut-off blade that moves a V-shaped blade edge toward the fixed blade 41. The movable blade 42 and the fixed blade 41 can cut the recording paper P from both ends of the recording paper P while sliding their cutting edges against each other.

The recording paper P is printed by the printing section 20, cut by the cutter 40, and ejected through the outlet 55.

It should be noted that the movable blade 42 may also be formed by a rectangular parallelepiped piece of metal, and the tip of one of the sides may be a cutting edge. In this case, the movable blade 42 is a so-called scissors-type blade, which is pivotally supported about a support shaft provided behind the cover 51. The cutter motor 43 causes the movable blade 42 to pivot about the support shaft, move from one end of the cutting edge of the movable blade 42 toward the other end with respect to the fixed blade 41, and cut the recording paper P while sliding against the fixed blade 41.

When the cover 51 is closed, the sub-substrate 61 is disposed to face the cover 51 across the container 50. In other words, when the cover 51 is closed, the cover 51 is located on one side and the sub-substrate 61 is disposed on the other side with at least the part E of the container 50 therebetween.

As a result, when the cover 51 is closed, a surface of the sub-substrate 61 is disposed to face a surface of the cover 51 on the opposite side of the cover 51 located across the container 50.

Since the sub-substrate 61 is disposed parallel to the closed cover 51, the transport motor 31 can be efficiently disposed in the space between this sub-substrate 61 and the closed cover 51, and the size of the printing apparatus 1 can be reduced.

The controller 10 illustrated in FIG. 1 includes a central processing unit (CPU), which comprehensively controls various portions of the printing apparatus 1, a universal asynchronous receiver transmitter (UART), which manages input and output, and a field-programmable gate array (FPGA) and a programmable logic device (PLD), which are logic circuits. A CPU is also referred to as a processor.

Examples of the storage 11 include a flash ROM (read-only memory), which is rewritable non-volatile memory, a hard disk drive (HDD), random access memory (RAM), which is volatile memory, and the like.

The CPU of the controller 10 reads a program such as firmware stored in the non-volatile memory of the storage 11 and executes the read program using the RAM of the storage 11 as a work area.

Figure 4:
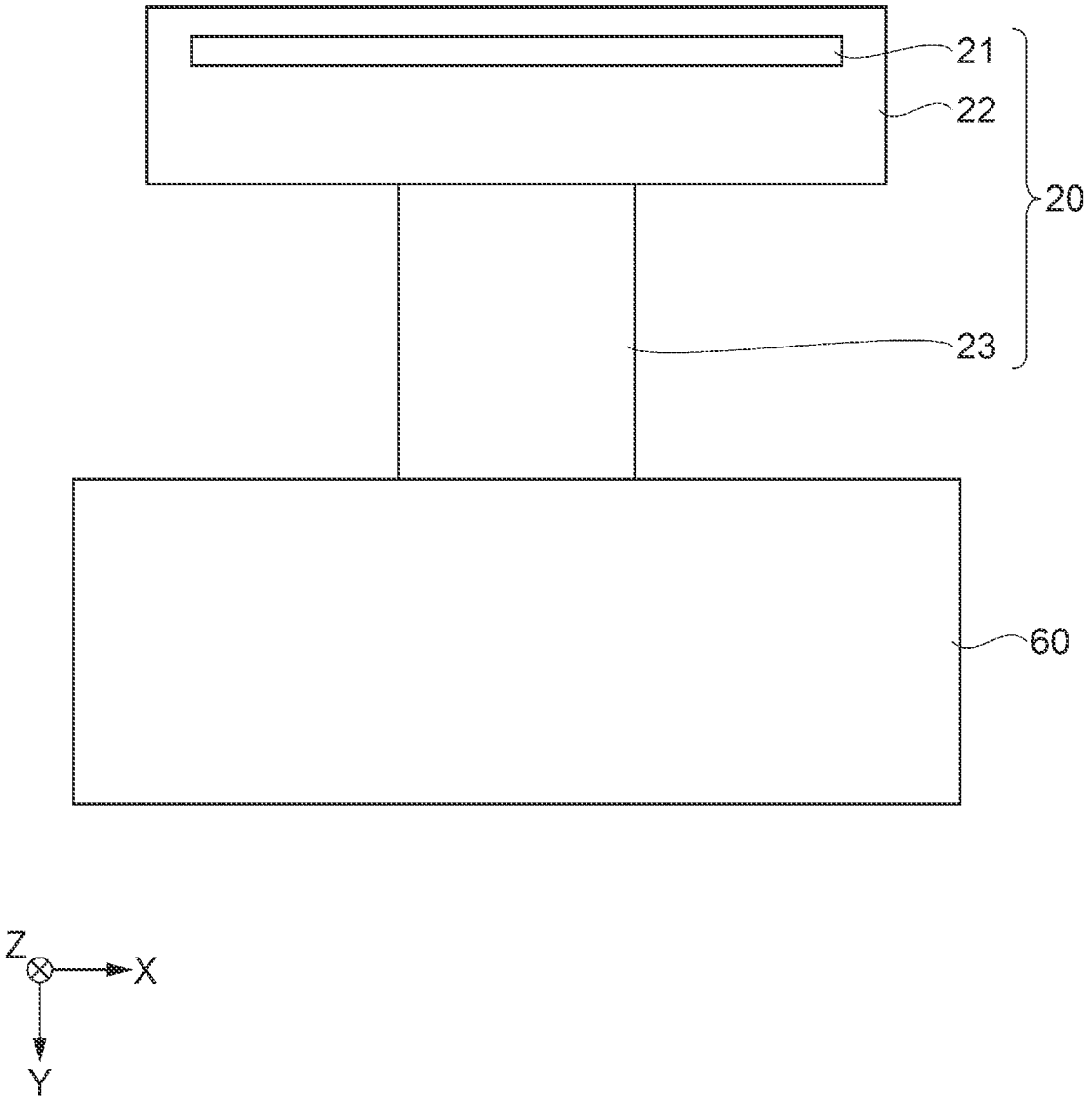
FIG. 4 is a schematic diagram of a printing section.

As illustrated in FIG. 4, the printing section 20 includes the head 21, a head substrate 22, and a flexible flat cable (FFC) 23. Specifically, the head 21 is disposed on the head substrate 22 made of ceramic or the like. The head 21 and the main substrate 60 are coupled to each other by a cable such as the FFC 23.

When receiving print data from the computer of the POS system or the like via the communication section 12, the controller 10 on the main substrate 60 generates a control signal for controlling the head 21 and applies the generated signal to the head 21 via the FFC 23. The head 21 prints a receipt on the recording paper P in accordance with the applied control signal.

The power supply 13 receives AC or DC electric power from an external source and supplies electric power to actuators, such as the head 21 of the printing section 20, the transport motor 31 of the transporter 30, and the cutter motor 43 of the cutter 40, by generating a drive voltage, such as 24 V.

In addition, the power supply 13 supplies electric power to circuits, such as the controller 10, the storage 11, and the communication section 12, by generating a logic voltage, such as 3.3 V.

The external connectors for the communication section 12 and the power supply 13 may be large connectors and may require large amounts of space for installation. For example, the external connectors may be larger than the internal connectors that couple the main substrate 60 and the sub-substrate 61 to each other.

When the space around the main substrate 60 is compared with the space around the sub-substrate 61, it is easier to obtain sufficient space around the sub-substrate 61 for installing the external connector because the printing section 20, the FFC 23, and the like are not present nearby and the printing apparatus 1 has fewer structural components. Accordingly, the size of the printing apparatus 1 can be further reduced by mounting the communication section 12 and the power supply 13 on the sub-substrate 61.

Since the communication section 12 and the power supply 13 are mounted on the sub-substrate 61 as described above, a plurality of cables extend externally from the plurality of external connectors. The plurality of cables are to be wired so as not to cause an obstruction on the counter on which the printing apparatus 1 is installed.

For this reason, the external connectors to which the plurality of cables are coupled may be placed together on the opposite side of the outlet 55, that is, on the opposite side of the cover 51 inside the printing apparatus 1. In other words, the sub-substrate 61 on which the communication section 12 and the power supply 13 are mounted may be disposed to face the closed cover 51 on the opposite side of the cover 51 inside the printing apparatus 1. In the arrangement described above, it is possible to reduce the space required to install the printing apparatus 1 as well as to wire the plurality of cables.

As described above, the controller 10 sends, via the FFC 23, the control signal for controlling the head 21 of the printing section 20. The size of the printing apparatus 1 can be reduced by reducing the space in which the FFC 23 extends in the printing apparatus 1.

Accordingly, the controller 10 may be disposed near the head 21 to shorten the FFC 23.

The main substrate 60 is disposed with the sub-substrate 61 and the container 50 to surround the transport motor 31 and is located closer than the sub-substrate 61 to the head 21. Accordingly, the controller 10 may be mounted on the main substrate 60 instead of on the sub-substrate 61. As a result, since the FFC 23 can be shortened, the space in which the FFC 23 extends is smaller and the size of the printing apparatus 1 can be reduced.

In addition, the control signal contains a higher frequency signal with a frequency of, for example, 4 MHz. As the FFC 23 becomes longer, the control signal is more easily attenuated and high-frequency noise is more likely to propagate from the FFC 23 to other components.

Accordingly, the controller 10 may be disposed near the head 21 to shorten the FFC 23. In addition, the storage 11 from or to which the controller 10 reads or writes information may also be disposed near the controller 10. Accordingly, the controller 10 and the storage 11 may be mounted on the main substrate 60.

Figure 5:
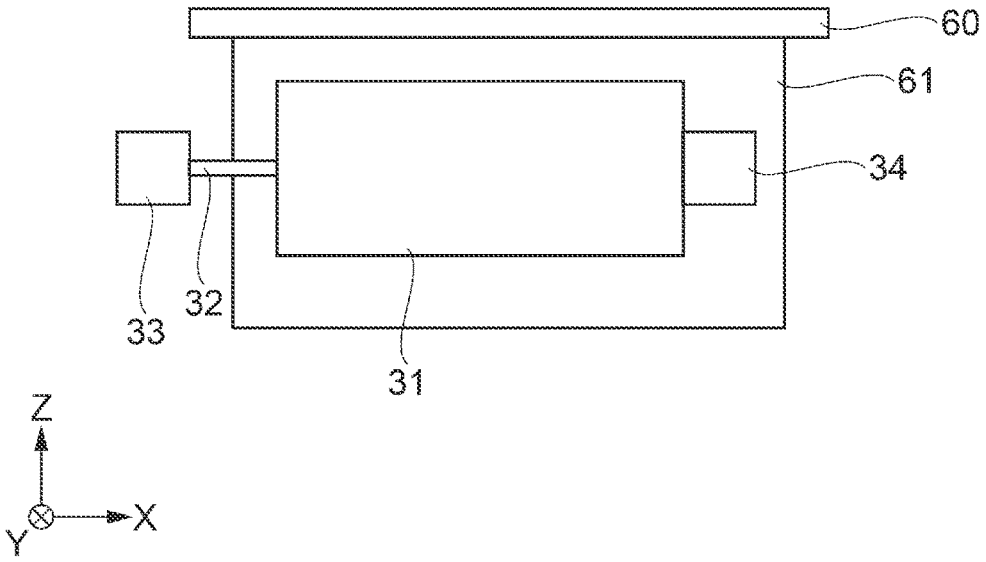
FIG. 5 is a schematic diagram in which a transport motor is centered.

The transport motor 31 of the transporter 30 is, for example, a direct current (DC) motor. As illustrated in FIG. 5, the transport motor shaft 32 of the transport motor 31 has an encoder 34 that detects the rotation of the transport motor 31.

The encoder 34 is a so-called rotary encoder. The encoder 34 includes a disc, which is a scale with slits formed at predetermined intervals, and a transmission photo sensor that detects the slits of the disc. The disc is attached to the transport motor shaft 32 and rotates with the transport motor shaft 32. The photo sensor having detected the slits of the rotating disc outputs a pulse signal with a width corresponding to the rotation of the transport motor 31.

The controller 10 receives the pulse signal from the encoder 34, calculates the speed of the transport motor 31, and performs pulse width modulation (PWM) control of the transport motor 31 to rotate the transport motor 31 at a predetermined speed.

Specifically, the controller 10 can perform control to obtain a desired rotational speed by receiving, as the feedback, the rotational speed of the transport motor 31 obtained from the pulse signal of the encoder 34 and adjusting the timing for when the drive voltage applied to the transport motor 31 is switched on and off.

As illustrated in FIG. 5, the encoder 34 is provided on the transport motor shaft 32 to the right of the transport motor 31. As a result, the encoder 34 can be disposed with the transport motor 31 in the dead space, which is an empty space in the printing apparatus 1 surrounded by the main substrate 60, the sub-substrate 61, and the container 50.

Specifically, the encoder 34 is also disposed in the direction of the transport motor shaft 32 of the transport motor 31 to fit the dead space extending to the left and right within the printing apparatus 1 so that the size of the printing apparatus 1 can be further reduced.

As illustrated in FIG. 5, a transport motor gear 33 is provided to the left of the transport motor shaft 32 of the transport motor 31.

In addition, as illustrated in FIG. 6, the wheel row 38 is provided on the opposite side of the encoder 34 in the transport motor 31. The wheel row 38 engages the transport motor gear 33 and transmits the torque of the transport motor 31 to the transport roller 35. The wheel row 38 includes a combination of a plurality of gears and transmits the torque to the transport roller 35 while reducing the rotational speed of the transport motor 31.

The transport roller gear 37 of the transport roller 35 is also disposed in the space on the left side in the printing apparatus 1. The wheel row 38 engages the transport roller gear 37 and rotates the transport roller 35 clockwise.

As illustrated in FIG. 6, the transport motor gear 33 of the transport motor 31, the wheel row 38, and the transport roller gear 37 of the transport roller 35 are included in the transporter 30 and efficiently disposed in the space on the left side in the printing apparatus 1. As a result, the size of the printing apparatus 1 can be further reduced.

In the embodiments described above, the main substrate 60, the sub-substrate 61, and the container 50 can be disposed to surround the transport motor 31 in the dead space, which is an empty space having no other components, in the printing apparatus 1. As a result, there is no need to create additional space for disposing the transport motor 31, and the size of the printing apparatus 1 can be reduced.

Furthermore, the transport motor shaft 32 of the transport motor 31 is disposed parallel to the transport roller shaft 36 of the transport roller 35. Since the transport motor 31 and the transport roller 35 can be efficiently disposed parallel to each other and the dead space can be suppressed, the size of the printing apparatus 1 can be further reduced.

These embodiments have been described in detail with reference to the drawings, but the specific structure is not limited to these embodiments, and changes, replacement, or removal can be made without deviating from the spirit of the present disclosure.

Although the head 21 of the printing apparatus 1 is a line thermal head in the example described above, the head 21 may be of any type. For example, the head 21 may be a line ink jet head.

Although the recording paper P is thermal paper in the example described above, the recording paper P may be plain paper when the head 21 is an ink jet head.

Alternatively, the recording paper P may be a label form with a shaped label attached to a mat board. The printing apparatus 1 may be a label-issuing device installed in a shop. In this case, a photo sensor may be provided to detect the position of the label attached to the mat board at a position downstream of the pull position S in the transport direction of the recording paper P. For example, when the photo sensor is a reflective type, a light emitter and a light receiver need only be disposed in either the guide 53 of the cover 51 or the container 50 at the position of the photo sensor. Alternatively, when the photo sensor is a transmissive type, a light emitter and a light receiver need only be disposed in the guide 53 of the cover 51 and the container 50, respectively. In addition, the cutter 40 does not need to be provided. Instead of the cutter 40, a peeling mechanism for peeling the label off the backing paper may be provided in the outlet 55.

Although the transport motor 31 is a DC motor in the example described above, the transport motor 31 may be another system such as a step motor. In addition, the transport motor 31 has been described to have a cylindrical shape but may have any other shape. The transport motor 31 needs only to have a shape that can be disposed in the dead space surrounded by the main substrate 60, the sub-substrate 61, and the container 50.

Alternatively, the encoder 34 may be another detection system, such as a tachogenerator.

Although the transmitter that transmits the torque of the transport motor 31 to the transport roller 35 is the wheel row 38 having a plurality of gears in the example described above, the torque may also be transmitted by a belt.

Although the head 21 and the main substrate 60 are coupled to each other by the FFC 23, a flexible printed circuit (FPC) or a flat cable may also be used.

What is claimed is:

1. A printing apparatus comprising:

a container configured to accommodate roll paper in which recording paper is wound;

a cover for opening and closing the container;

a transporter including a transport motor and a transport roller, the transporter pulling the recording paper from the roll paper and transporting the recording paper;

a printing section performing printing on the recording paper at a position facing the transport roller;

a first substrate having a controller controlling the printing section; and a second substrate disposed to intersect the first substrate, wherein the transport motor is disposed in a space formed by the first substrate, the second substrate, and the container, a shaft of the transport motor is disposed parallel to a shaft of the transport roller, and the second substrate is disposed to face the cover at a position at which the container is closed by the cover with the container between the second substrate and the cover.

2. A printing apparatus comprising:

a container configured to accommodate roll paper in which recording paper is wound;

a cover for opening and closing the container;

a transporter including a transport motor and a transport roller, the transporter pulling the recording paper from the roll paper and transporting the recording paper;

a printing section performing printing on the recording paper at a position facing the transport roller;

a first substrate having a controller controlling the printing section; and a second substrate disposed to intersect the first substrate, wherein the transport motor is disposed in a space formed by the first substrate, the second substrate, and the container, a shaft of the transport motor is disposed parallel to a shaft of the transport roller, the transport motor is a DC motor, and an encoder detecting rotation is disposed on the shaft of the transport motor.

3. The printing apparatus according to claim 2, wherein, a wheel row that transmits torque of the transport motor to the transport roller is disposed on an opposite side in the transport motor of the encoder.

4. A printing apparatus comprising:

a container configured to accommodate roll paper in which recording paper is wound;

a cover for opening and closing the container;

a transporter including a transport motor and a transport roller, the transporter pulling the recording paper from the roll paper and transporting the recording paper;

a printing section performing printing on the recording paper at a position facing the transport roller;

a first substrate having a controller controlling the printing section;

a second substrate disposed to intersect the first substrate;

a communication section configured to receive printing data; and a power supply supplying electric power to the transporter and the printing section, wherein the communication section and the power supply are mounted on the second substrate, the transport motor is disposed in a space formed by the first substrate, the second substrate, and the container, and a shaft of the transport motor is disposed parallel to a shaft of the transport roller.

5. A printing apparatus comprising:

a container configured to accommodate roll paper in which recording paper is wound;

a cover for opening and closing the container;

a transporter including a transport motor and a transport roller, the transporter pulling the recording paper from the roll paper and transporting the recording paper;

a printing section performing printing on the recording paper at a position facing the transport roller;

a first substrate having a controller controlling the printing section; and a second substrate disposed to intersect the first substrate, wherein the transport motor is disposed in a space formed by the first substrate, the second substrate, and the container, the first substrate, the second substrate, and the container each forming a different side of the space, and a shaft of the transport motor is disposed parallel to a shaft of the transport roller.

* * * * *